US005435144A

United States Patent [19]

Kalmbach

[11] Patent Number: 5,435,144

[45] Date of Patent: Jul. 25, 1995

[54] COMPRESSOR LUBRICANT DISTRIBUTING SYSTEM FOR MOTOR VEHICLES HAVING AUXILIARY AIR CONDITIONING

[76] Inventor: John Kalmbach, 9805 Gray Blvd., Austin, Tex. 78758

[21] Appl. No.: 202,332

[22] Filed: Feb. 24, 1994

[51] Int. Cl.[6] ..... F25B 39/04

[52] U.S. Cl. ..... 62/84; 62/193; 62/469

[58] Field of Search ..... 62/84, 193, 239, 468, 62/469

[56] References Cited

U.S. PATENT DOCUMENTS

| | | | |
|---|---|---|---|
| 2,663,164 | 12/1953 | Kurtz | 62/84 |
| 3,494,137 | 2/1970 | Cargo | 62/84 |
| 3,581,519 | 6/1971 | Garrett et al. | 62/468 |
| 3,621,670 | 1/1972 | Kinney | 62/192 |
| 3,777,509 | 12/1973 | Muench | 62/470 |
| 3,785,169 | 1/1974 | Gylland, Jr. | 62/468 |
| 4,179,248 | 12/1979 | Shaw | 417/427 |
| 4,383,802 | 5/1983 | Gianni et al. | 417/12 |
| 4,404,812 | 9/1983 | Zinsmeyer | 62/84 |
| 4,411,141 | 10/1983 | Hara | 62/468 |
| 4,537,047 | 8/1985 | Seshadri et al. | 62/510 |
| 4,551,989 | 11/1985 | Lindahl et al. | 62/468 |
| 4,554,795 | 11/1985 | Ibrahim | 62/175 |
| 4,589,263 | 5/1986 | DiCarlo et al. | 62/193 |
| 4,729,228 | 3/1988 | Johnsen | 62/510 |
| 4,750,337 | 6/1988 | Glamm | 62/468 |
| 4,870,831 | 10/1989 | Kitamoto | 62/84 |

*Primary Examiner*—Henry A. Bennet
*Assistant Examiner*—William C. Doerrler
*Attorney, Agent, or Firm*—Shaffer & Culbertson; Russell D. Culbertson

[57] ABSTRACT

A compressor lubricant distributing system includes a suction outlet to an auxiliary compressor housing and a lubricant and refrigerant return conduit. The return conduit extends from the suction outlet associated with the auxiliary compressor to a suction inlet conduit leading to a suction inlet of a primary compressor. The suction outlet associated with the auxiliary compressor is positioned at a proper lubricant level in the auxiliary compressor housing. When the primary compressor is operated, the suction created at its suction inlet is applied to the suction outlet associated with the auxiliary compressor, this suction draws excess lubricant at the auxiliary compressor back to the primary compressor.

6 Claims, 2 Drawing Sheets

COMPRESSOR LUBRICANT DISTRIBUTING SYSTEM FOR MOTOR VEHICLES HAVING AUXILIARY AIR CONDITIONING

BACKGROUND OF THE INVENTION

This invention relates to air conditioning systems for motor vehicles. More particularly this invention relates to a lubricant distribution system that returns lubricant to one compressor after operating an auxiliary compressor in an air conditioning system.

Many motor vehicles, particularly van conversions and other recreational vehicles (Rvs) have air conditioning systems with dual compressors. One of the compressors in these dual compressor air conditioning systems is a primary compressor driven by the vehicle engine. The other compressor, an auxiliary compressor, is driven by an electric motor rather than through the vehicle engine. The electric motor for the auxiliary compressor may be powered by a generator or by a stationary hook-up such as at an RV park, for example. These dual compressors share a condenser and are connected to alternatively direct refrigerant through one or more evaporators. In these types of systems, both compressors are never operated at the same time. Rather, the primary compressor driven by the vehicle engine is operated when the vehicle engine is running, and the auxiliary compressor is driven when the vehicle engine is not running, such as at an overnight campsite.

Both the engine-driven primary compressor and the auxiliary compressor require lubricating oil for proper operation. However, the lubricating oil in each compressor mixes with the refrigerant being compressed and continuously exits the compressor through the refrigerant lines as the compressor is operating.

The vehicle driven compressors commonly do not have a substantial reservoir of lubricant. These common vehicle compressors with no appreciable sump or lubricant reservoir rely on oil mixed with refrigerant in the compression process to return through the refrigerant conduits to the compressor and shall be referred to herein as entrained lubricant-type compressors. However, in air conditioning systems with an auxiliary electrically driven compressor, the refrigerant does not flow through the primary compressor when the auxiliary compressor is operating. Instead, lubricating oil removed from the engine-driven primary compressor collects in the auxiliary compressor when the auxiliary compressor is operating. Eventually the primary compressor loses adequate lubrication and is damaged by operating in this lubricant starved state.

SUMMARY OF THE INVENTION

It is a general object of the invention to overcome the above-described problems and others associated with vehicle air conditioning systems having electrically driving auxiliary compressors. More particularly, it is an object of the invention to provide a lubricant distribution system that prevents oil starvation in either compressor of a dual compressor vehicle air conditioning system.

In order to accomplish this objective, the invention includes a separate suction outlet in the auxiliary compressor housing and an oil and refrigerant return conduit connected to this auxiliary compressor suction outlet. The return conduit also connects at its other end to a low pressure conduit leading to the suction inlet of the primary compressor. The suction outlet in the auxiliary pump housing or casing is positioned at a proper level of lubricant in the auxiliary compressor housing.

When the auxiliary compressor operates, oil or lubricant collects in the auxiliary compressor housing above the proper level. When the primary compressor is again turned on, however, oil above the proper level collected in the auxiliary compressor housing is pulled by suction through the return conduit and back to the primary compressor suction inlet. Thus the return conduit and separate suction outlet in the auxiliary compressor housing return lubricant to the primary compressor after the auxiliary compressor has been operating.

These and other objects, advantages, and features of the invention will be apparent from the following description of the preferred embodiments, considered along with the accompanying drawings.

DESCRIPTION OF THE PREFERRED EMBODIMENTS

Figure 1:
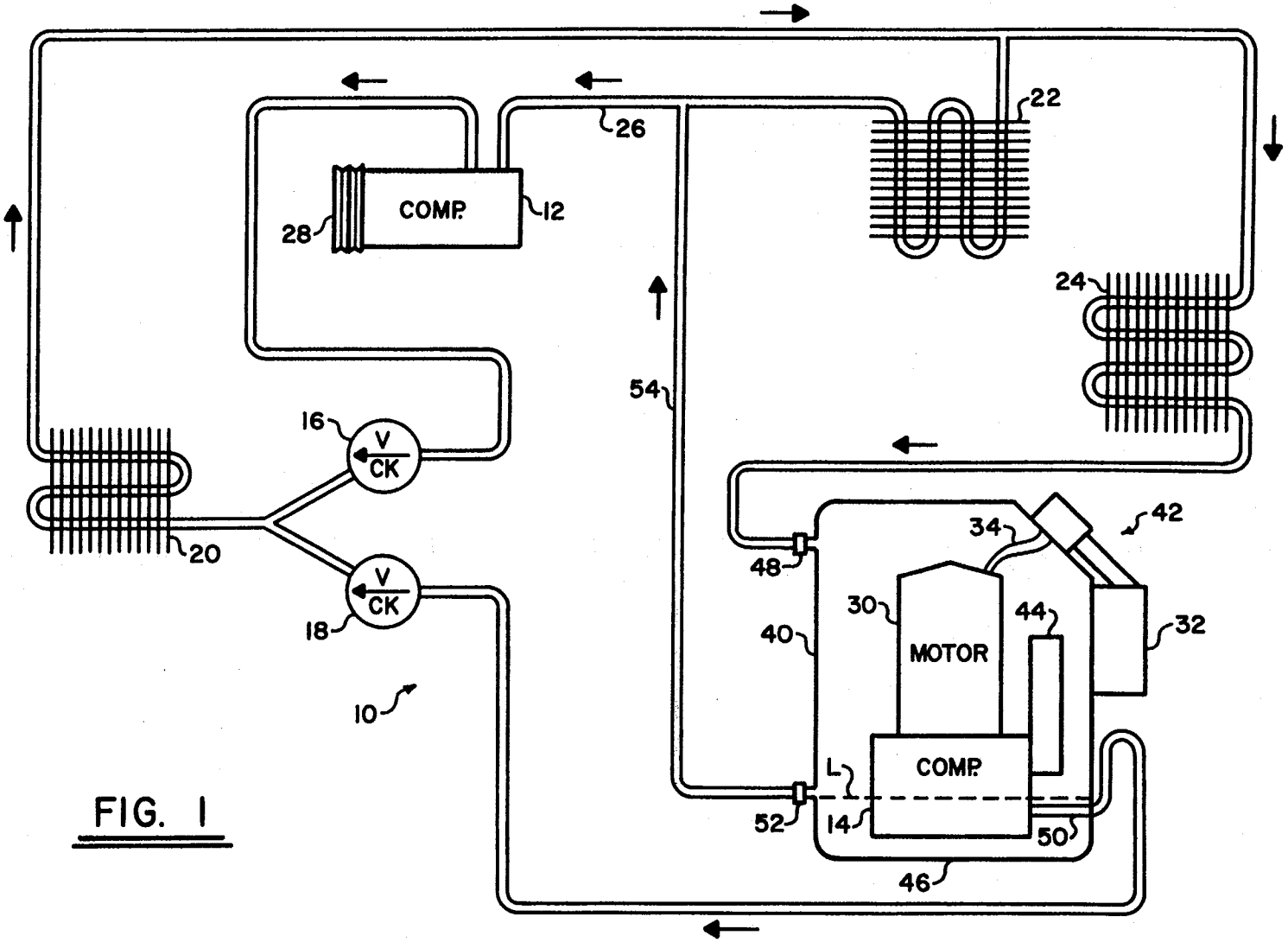
FIG. 1 is a mostly diagrammatic representation of a compressor lubricant distributing apparatus and auxiliary air conditioning system embodying the principles of the invention.

FIG. 1 shows a lubricant distributing system embodying the principles of the invention. The invention is used in air conditioning systems such as that shown generally at reference numeral 10 in FIG. 1, with two or more compressors that share refrigerant and operate at alternate times. This sort of air conditioning system is common in Rvs and van conversions which have an auxiliary air conditioning arrangement for operating when the vehicle is not running to drive a primary compressor.

The illustrated multiple compressor air conditioning system 10 includes a primary compressor 12 and an auxiliary compressor 14, both directing their output through check valves 16 and 18, respectively, to a common condenser 20. The output from the condenser 20 leads to a first evaporator 22 and perhaps a separate second evaporator 24. The first evaporator 22 returns the refrigerant and entrained oil or lubricant back to the primary compressor 12 through a suction inlet conduit 26. The second evaporator 24 shown in the figure returns refrigerant and oil to the auxiliary compressor 14.

The primary compressor 12 includes a shive or pulley arrangement 28, or some other arrangement, to allow the vehicle engine (not shown) to drive the compressor. The compressor 12 may be any type of compressor, including a rotary, scroll, or reciprocating type compressor.

The auxiliary compressor 14 may also be any suitable mechanical type, including rotary, scroll, or reciprocating. However, the auxiliary compressor 14 is driven by an electric motor 30 which is operated and controlled through an appropriate electrical controls shown generally at 32 and electrical connection 34 (the electrical power input to controls 32 is not shown). Also, the auxiliary compressor 14 has associated with it a low pressure refrigerant housing or casing 40 through which refrigerant returns to the compressor. Although not necessary to the operation of the invention, the illustrated auxiliary compressor 14 is part of a hermetically sealed compressor unit 42 in which the compressor 14 and electric motor 30 are both sealed within the housing 40. Low pressure refrigerant and any entrained oil enter the auxiliary compressor 14 itself through an auxiliary compressor suction inlet 44 connected to the compressor. The low pressure refrigerant housing 40 includes an oil reservoir or sump 46 at its bottom for collecting oil and providing the oil as lubricant to the auxiliary compressor 14. The housing 40 also includes a low pressure refrigerant return inlet 48 for returning refrigerant from the second evaporator 24 to the auxiliary compressor 14. High pressure refrigerant from the auxiliary compressor 14 exits the compressor and housing 40 through the high pressure outlet 50.

Those skilled in the art will readily appreciate that the diagrammatic representation of FIG. 1 is simplified to omit certain details of the refrigeration system 10 which incorporates the lubricant distributing arrangement of the invention. For example, each evaporator will have associated with it an expansion valve or some other type of pressure reducing device. These refrigeration system elements are well known to those in the field and, since they are not important to the disclosure of the invention, are omitted to simplify the drawings.

According to the invention, the low oil pressure refrigerant housing 40 of the auxiliary compressor 14 also includes a suction outlet 52. The suction outlet 52 is positioned at a proper lubricant level in the housing shown at line L. A refrigerant and oil return conduit 54 is connected at one end to the auxiliary compressor suction outlet 52 and connected at the other end to the suction inlet conduit 26 to the primary compressor 12.

In operation, the primary compressor 12 is driven by the vehicle engine (not shown) to provide air conditioning when the engine is running. The electric motor 30 drives the auxiliary compressor 14 to provide air conditioning when the vehicle engine is not running. However, due to the nature of the auxiliary compressor 14 and its associated low pressure housing 40, oil or lubricant from the system 10, including oil from the primary compressor 12 collects in the reservoir 46 as the auxiliary compressor operates. Excess oil in the reservoir 46 rises above the proper level shown at L.

When the primary compressor 12 operates again after the auxiliary compressor 14 has been operated, the suction produced by the primary compressor is applied to the auxiliary compressor housing 40 through the return conduit 54 and housing suction outlet 52. Applying this suction from the primary compressor 12 draws oil or lubricant that is above the proper level L into the return conduit 54 and back into the primary compressor through the primary compressor suction inlet conduit 26. Thus, the suction outlet 52 in the auxiliary compressor housing 40 and return conduit 54 ensure proper lubrication to the primary compressor 12 to prevent lubricant starvation and damage to the compressor. Once excess oil in the housing 40 is removed, low pressure refrigerant simply flows through the return conduit 54 and the oil level in the auxiliary compressor housing 40 remains at the proper level.

In the illustrated form of the invention shown in FIG. 1, the air conditioning system 10 includes two separate evaporators 22 and 24. In Rvs, for example, the first evaporator may be in the vehicle cab while the second evaporator may be located in the back of the vehicle. However, the lubricant distributing system according to the invention may be used with a single evaporator.

Figure 2:
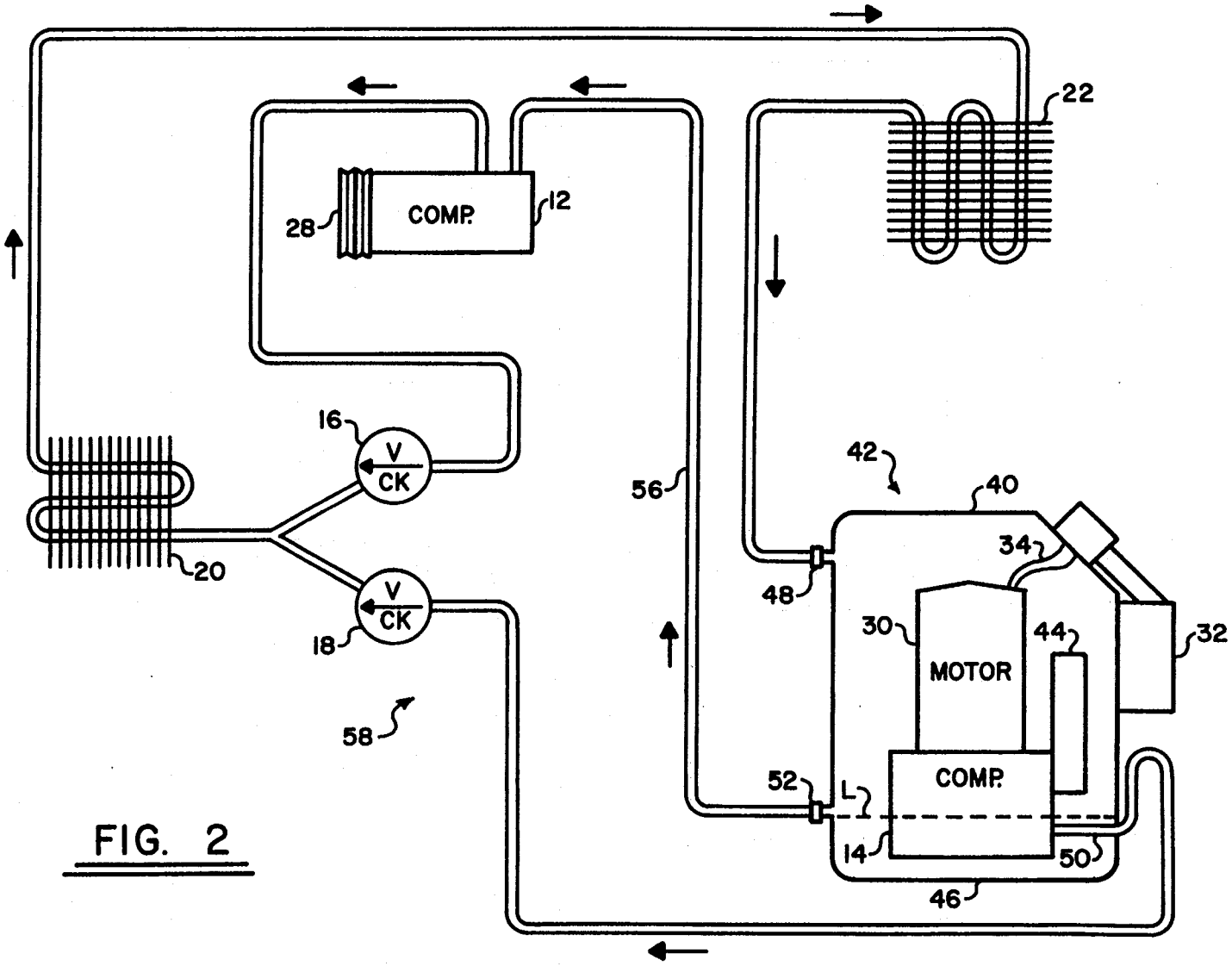
FIG. 2 is a mostly diagrammatic representation of an alternate compressor lubricant distributing system for the use with a single evaporator.

FIG. 2 shows an alternative system 58. As shown in FIG. 2, high pressure refrigerant flows from the condenser 20 to the single evaporator 22. Low pressure refrigerant flows in a conduit from the evaporator 22 to the primary compressor 12 only through the auxiliary compressor housing 40 and a return conduit 56. In this form of the invention the return conduit 56 and suction outlet 52 cooperate to return excess lubricant from the auxiliary compressor housing 40 to the primary compressor 12.

The above described preferred embodiments are intended to illustrate the principles of the invention, but not to limit the scope of the invention. Various other embodiments and modifications to these preferred embodiments may be made by those skilled in the art without departing from the scope of the following claims. For example, various types of compressors may be used within the scope of the invention. The lubricant distributing system according the invention is useful with any auxiliary compressor arrangement that includes a housing that collects low pressure refrigerant and oil for an auxiliary compressor. Thus, the invention is not limited to the hermetically sealed auxiliary compressor shown in the figures.

I claim:

1. A compressor lubricant distributing apparatus for an air conditioning system having a primary compressor and an auxiliary compressor both connected to direct high pressure refrigerant to a common condenser and a common evaporator connected between the condenser and the auxiliary compressor, the lubricant distributing system comprising:

(a) an entrained lubricant-type compressor comprising the primary compressor;

(b) a low pressure refrigerant housing associated with the auxiliary compressor and in which lubricant and refrigerant collect during operation of the air conditioning system;

(c) a suction outlet in the low pressure refrigerant housing associated with the auxiliary compressor, the suction outlet being positioned at a proper lubricant level in the low pressure refrigerant housing; and (d) a low pressure refrigerant and lubricant return conduit connected between the suction outlet of the low pressure refrigerant housing and a suction inlet of the primary compressor.

2. The apparatus of claim 1 wherein the air conditioning system is mounted on a vehicle and the primary compressor is driven by the vehicle engine.

3. The apparatus of claim 1 wherein the auxiliary compressor is mounted within the low pressure refrigerant housing, and further comprising:

(a) an auxiliary compressor suction inlet connected to the auxiliary compressor for admitting refrigerant from the low pressure refrigerant housing to the auxiliary compressor; and (b) a lubricant reservoir positioned in a bottom of the low pressure refrigerant housing.

4. A multiple compressor air conditioning system for a motor vehicle, the system comprising:

(a) an entrained lubricant-type primary compressor driven by the vehicle engine and having a primary compressor suction inlet;

(b) an auxiliary compressor driven by an electric motor and having associated therewith a low pressure refrigerant housing in which lubricant and refrigerant collect during operation of the air conditioning system;

(c) a common condenser connected to receive high pressure refrigerant from both the primary compressor and auxiliary compressor;

(d) a first evaporator connected to receive high pressure refrigerant from the condenser;

(e) an auxiliary compressor suction conduit extending from the first evaporator to a suction inlet of the low pressure refrigerant housing;

(f) a suction outlet in the low pressure refrigerant housing, the suction outlet positioned at a proper lubricant level in the low pressure refrigerant housing; and (g) a low pressure refrigerant and oil return conduit connected between the suction outlet of the auxiliary compressor and the primary compressor suction inlet for enabling excess lubricant collected in the low pressure refrigerant housing of the auxiliary compressor to be drawn back to the primary compressor when the primary compressor is operating and producing a suction at its suction inlet.

5. The air conditioning system of claim 4 further comprising:

(a) an auxiliary compressor suction inlet connected to the auxiliary compressor for admitting refrigerant from the low pressure refrigerant housing to the auxiliary compressor; and (b) a lubricant reservoir positioned in a bottom of the low pressure refrigerant housing.

6. A method of distributing compressor lubricant in a motor vehicle air conditioning system having dual compressors, the method comprising the steps of:

(a) applying a suction from a suction inlet of an entrained lubricant-type primary compressor to a lubricant collecting housing adapted to collect low pressure refrigerant and lubricant for an auxiliary compressor, the suction being applied at a proper lubricant level in the lubricant collecting housing; and (b) with the suction applied from the suction inlet of the primary compressor, drawing lubricant from the lubricant collecting housing to the primary compressor.

* * * * *